US012145772B2

(12) United States Patent
Sullivan

(10) Patent No.: US 12,145,772 B2
(45) Date of Patent: Nov. 19, 2024

(54) ICE BAG

(71) Applicant: John Sullivan, Tampa, FL (US)

(72) Inventor: John Sullivan, Tampa, FL (US)

( * ) Notice: Subject to any disclaimer, the term of this patent is extended or adjusted under 35 U.S.C. 154(b) by 0 days.

(21) Appl. No.: 17/710,084

(22) Filed: Mar. 31, 2022

(65) Prior Publication Data

US 2023/0257164 A1 Aug. 17, 2023

Related U.S. Application Data

(60) Provisional application No. 63/309,707, filed on Feb. 14, 2022.

(51) Int. Cl.
*B65D 33/00* (2006.01)
*B65D 81/18* (2006.01)

(52) U.S. Cl.
CPC ..... *B65D 33/00* (2013.01); *B65D 81/18* (2013.01)

(58) Field of Classification Search
CPC ..... B65D 33/00
USPC ..... 62/440–466; 312/1
See application file for complete search history.

(56) References Cited

U.S. PATENT DOCUMENTS 5,265,961 A * 11/1993 Boyd ..... B65D 31/12 383/104
6,050,726 A * 4/2000 Hoerl ..... E01H 1/1206 294/1.3
6,305,843 B1 * 10/2001 Helmer ..... B65D 33/00 383/41
6,374,577 B1 * 4/2002 Ventura ..... A45F 5/021 53/390
8,534,462 B1 * 9/2013 Tan ..... B65D 83/0847 206/554
10,550,533 B2 * 2/2020 Currie ..... E01H 1/1206

FOREIGN PATENT DOCUMENTS

CN 107265015 A * 10/2017
JP 2004075088 A * 3/2004
KR 20100134248 A * 12/2010
KR 20120017609 A * 2/2012
WO WO-8103007 A1 * 10/1981

OTHER PUBLICATIONS

KR20100134248ATranslation (Year: 2010).*

* cited by examiner

*Primary Examiner* — Jes F Pascua
*Assistant Examiner* — Nina K Attel
(74) *Attorney, Agent, or Firm* — Barry Choobin; Patent 360

(57) ABSTRACT

An ice bag for a cooler that include a bag with an open top. A flap having a top edge and a bottom edge, wherein the top edge of the flap is coupled to a portion of a periphery of the open top of the bag. A hand sleeve has an opening for a hand, wherein a rear periphery portion of the hand opening is coupled to the bottom edge of the flap. A user can insert a hand into the hand sleeve to grab ice cubes in the ice bag and transfer the ice cubes into a container.

1 Claim, 3 Drawing Sheets

ICE BAG

CROSS-REFERENCE TO RELATED APPLICATIONS

This application claims priority to the U.S. provisional patent application Ser. No. 63/309,707, filed on Feb. 14, 2022, which is incorporated herein by reference in its entirety.

FILED OF INVENTION

The present invention relates to an ice bag, and more particularly, the present invention relates to an ice bag for a cooler.

BACKGROUND

Portable coolers and ice bags are quite common outdoors for keeping the drinks and food cold. Generally, a layer of ice is applied around the container to keep the items cold. However, the water from the ice damages the food item. Moreover, the ice gets contaminated from the food items, dirty hands, and environmental contaminants. Being getting dirty, the ice in the cooler cannot be used for drinks. Thus, a need is appreciated for a device that allows using the ice for both cooling and as ice for drinks.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an ice bag for coolers that can prevent contamination of ice and the ice bag can be used in a cooler.

It is another object of the present invention that ice cubes from the ice bag can be used for drinks.

It is still another object of the present invention that the ice bag can cool the items placed in the cooler.

It is yet another object of the present invention that any contamination of the ice cubes by hands can be prevented.

It is a further object of the present invention that the ice bag is economical to manufacture.

It is an additional object of the present invention that the ice bag can prevent wetting of the items placed in the cooler.

In one aspect, disclosed is an icebag that can be used in a cooler for keeping the items cool and providing ice for use in drinks. The disclosed ice bag provides a barrier between the ice and items in the cooler. Moreover, the disclosed device can prevent the contamination of the ice by hand.

In one aspect, the disclosed ice bag can include a bag, the bag has at least one wall and optionally a base, wherein the bag has an interior volume and an open top. Pieces of ice, such as the ice cubes can be placed inside the bag, and the open top of the bag can optionally be closed.

In one aspect, disclosed is an ice bag comprising a bag that has an enclosed inner volume and an open top; a flap, the flap has a top edge and a bottom edge, wherein the top edge of the flap is coupled to a portion of a periphery of the open top of the bag; and a hand sleeve, the hand sleeve has a finger portion configured to receive fingers of a hand, a left thumb portion configured to receive a thumb of the hand, a right thumb portion configured to receive the thumb of the hand, and a palm portion, the hand sleeve has a hand opening, a front periphery portion of the hand opening is adjacent to a palm side of the hand sleeve, and a rear periphery portion of the hand opening is along a rear hand side of the hand sleeve, the rear periphery portion is coupled to the bottom edge of the flap. The hand opening is wide enough to permit the hand to freely insert into the hand sleeve and withdrawn from the hand sleeve. The hand sleeve is configured to loosely fit onto the hand. The hand sleeve and the flap are positioned within the bag.

In one aspect, disclosed is a method for keeping an enclosed insulated environment cold, the method comprising the steps of providing an ice bag, the ice bag comprises a bag that has an enclosed inner volume and an open top, a flap, the flap has a top edge and a bottom edge, wherein the top edge of the flap is coupled to a portion of a periphery of the open top of the bag, and a hand sleeve, the hand sleeve has a finger portion configured to receive fingers of a hand, a left thumb portion configured to receive a thumb of the hand, a right thumb portion configured to receive the thumb of the hand, and a palm portion, the hand sleeve has a hand opening, a front periphery portion of the hand opening is adjacent to a palm side of the hand sleeve, and a rear periphery portion of the hand opening is along a rear hand side of the hand sleeve, the rear periphery portion is coupled to the bottom edge of the flap. The method further includes the steps of filling ice cubes into the ice bag; inserting the hand into the hand sleeve; grabbing one or more of the ice cubes by the hand sleeve; and transferring the one or more of the ice cubes in a container.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, the reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an", and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention since the scope of the invention will be best defined by the allowed claims of any resulting patent.

Figure 1:
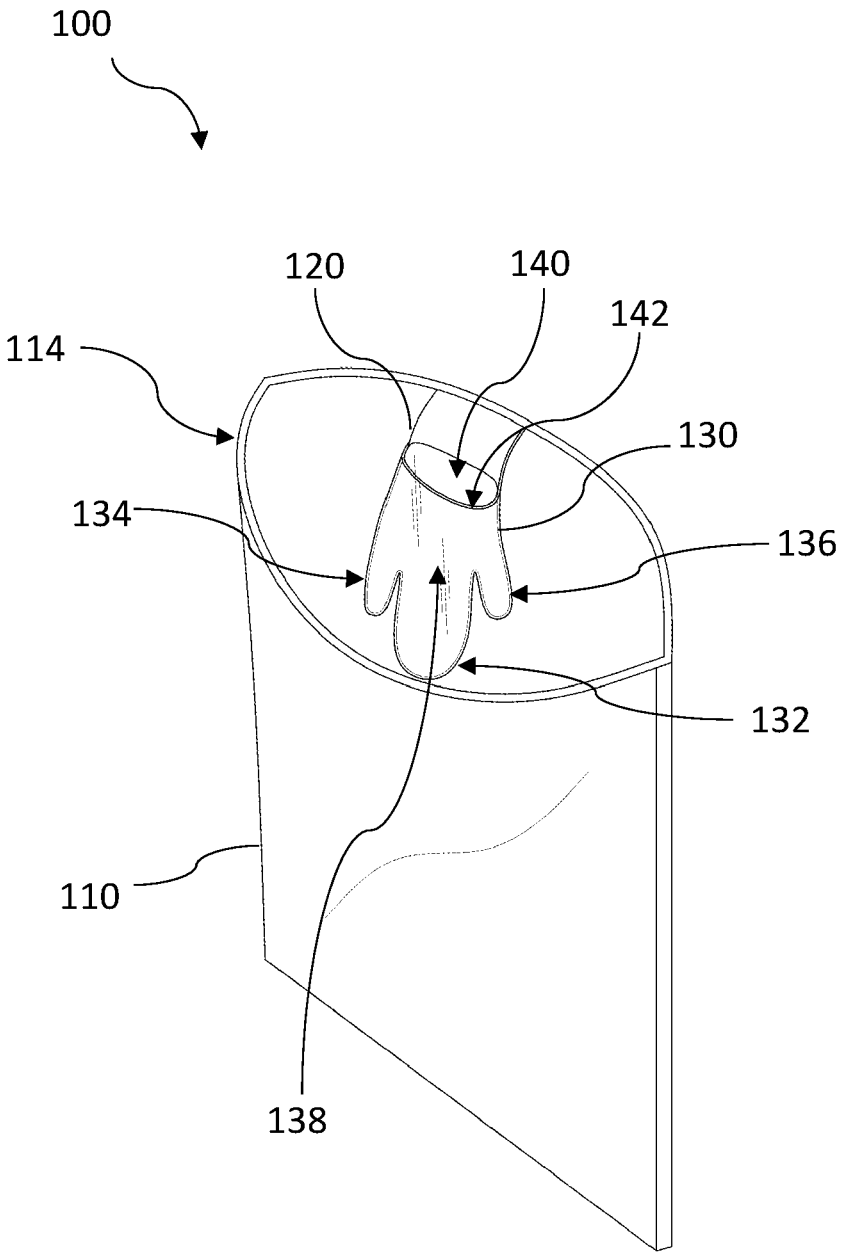
FIG. 1 is a perspective view of the disclosed ice bag, according to an exemplary embodiment of the present invention.
Figure 2:
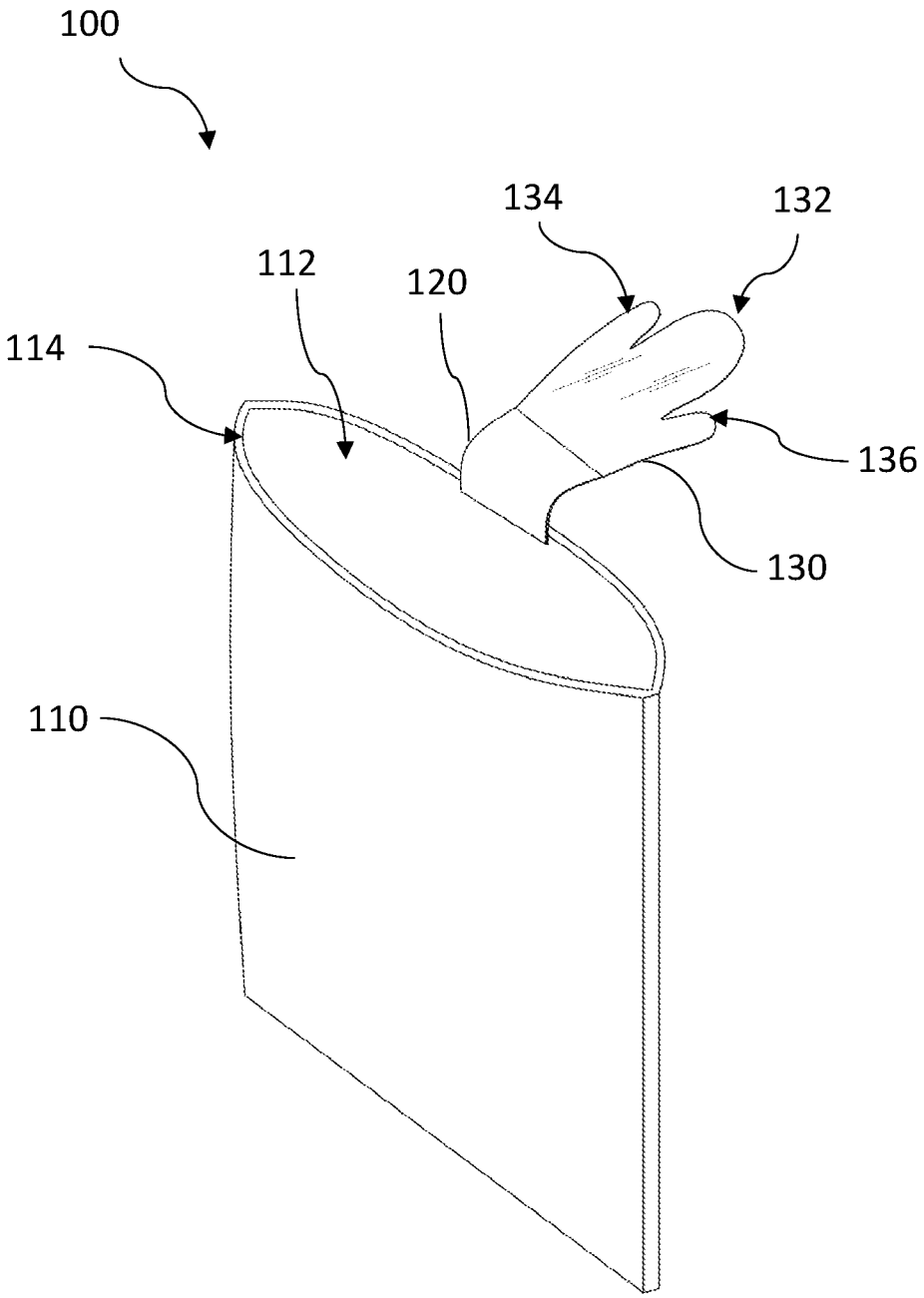
FIG. 2 shows the hand sleeve of the ice bag extended out, according to an exemplary embodiment of the present invention.

Disclosed is an ice bag that can contain ice, and the ice bag can be used to provide a cold environment. For example, the ice bag can be used in a cooler to keep items inside the cooler cold. Referring to FIGS. 1 and 2 which show an exemplary embodiment of the present invention, which is the ice bag 100. The ice bag can include a bag 110 that can hold pieces of ice, such as ice cubes. The bag 110 can include at least one wall and an optional base. For example, the at least one wall can be bonded at the sides and bottom to form an enclosed volume. Alternatively, the bag 110 can have a gusset at the bottom. A bag with four walls and a square base is also within the scope of the present invention. The top of the bag can be open, and ice cubes can be filled into the bag 110 from the open top 112. Optionally, the bag 110 can also have a suitable fastener to close the open top. The bag can be made from any flexible material, such as polymeric material. Moreover, the bag may be made of water-impermeable material.

The ice bag 100 can also include a flap 120 that has a top edge and a bottom edge. The top edge can be bonded to a portion of a periphery 114 of the open top 112 of the bag 110. As shown in FIG. 1, the flap can lie against the inner surface of the bag.

The ice bag 100 can further include a hand sleeve 130 that has a central finger portion 132, a left thumb portion 134, a right thumb portion 136, and a palm portion 138. The finger portion can receive the fingers of a hand. The two thumb portions may allow either the left hand or the right hand to be comfortably received within an inner volume of the hand sleeve. The two thumb portions, the finger portion, and the palm portion define the inner volume of the hand sleeve. The thumb of the left hand can be received into the right thumb portion while the thumb of the right hand can be received into the left thumb portion of the hand sleeve. Thus, the hand sleeve can be used by either the left hand or the right hand to grab ice from the bag. The hand sleeve can be loosely fit on the hand, such that the hand can be easily inserted and withdrawn from the hand sleeve. In one case, the hand sleeve can be made from a thick polymeric material that may not have any stretch or the stretch can be insignificant. The hand sleeve can have a wide opening 140 that allows the hand to be freely inserted into or withdrawn from the hand sleeve. The periphery of the opening of the hand sleeve can have a front side 142 and a rear side (opposite to the front side). The front side periphery 142 can be along a palm side of the hand sleeve (shown in FIG. 1) and the rear side periphery can be along the rear hand side of the hand sleeve (shown in FIG. 2). As shown in the drawing, the rear side periphery can be bonded to the bottom edge of the flap.

In use, ice can be filled into the ice bag and the ice bag can be placed into a cooler or similar insulated container. The ice bag can keep the inside of the insulated container cold. A user can insert either the left hand or the right hand into the hand sleeve and grab ice from the ice bag into a glass, bowl, or similar container. The hand sleeve is positioned within the bag as shown in FIG. 1.

Figure 3:
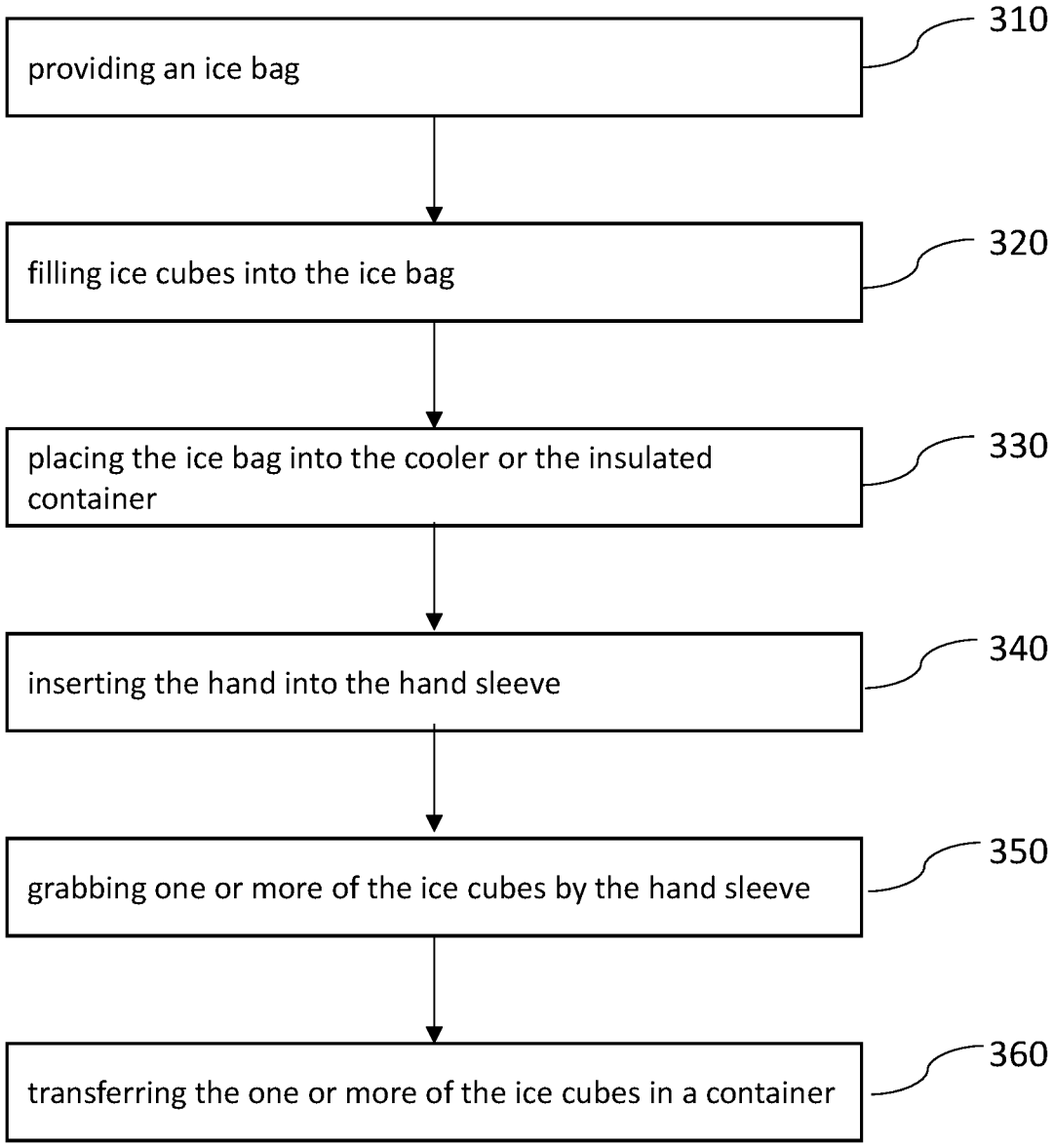
FIG. 3 shows the method of using the disclosed ice bag, according to an exemplary embodiment of the present invention.

Referring to FIG. 3 is a method for cooling a cooler or insulated container, the method comprising the steps of providing an ice bag, at step 310. The ice bag includes a bag that has an enclosed inner volume and an open top, a flap, the flap has a top edge and a bottom edge, wherein the top edge of the flap is coupled to a portion of a periphery of the open top of the bag, and a hand sleeve, the hand sleeve has a finger portion configured to receive fingers of a hand, a left thumb portion configured to receive a thumb of the hand, a right thumb portion configured to receive the thumb of the hand, and a palm portion, the hand sleeve has a hand opening, a front periphery portion of the hand opening is adjacent to a palm side of the hand sleeve, and a rear periphery portion of the hand opening is along a rear hand side of the hand sleeve, the rear periphery portion is coupled to the bottom edge of the flap, wherein the hand opening is wide enough to permit the hand to freely insert into the hand sleeve and withdrawn from the hand sleeve. The method further includes steps of filling ice cubes into the ice bag, at step 320; placing the ice bag into the cooler or the insulated container, at step 330; inserting the hand into the hand sleeve, at step 340; grabbing one or more of the ice cubes by the hand sleeve, at step 350; and transferring the one or more of the ice cubes in a container, at step 360.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A method for cooling a cooler or insulated container, the method comprising the steps of:

providing an ice bag, the ice bag comprises:

a bag that has an enclosed inner volume and an open top, a flap, the flap has a top edge and a bottom edge, wherein the top edge of the flap is coupled to a portion of a periphery of the open top of the bag, and a hand sleeve, the hand sleeve has a finger portion configured to receive fingers of a hand, a left thumb portion configured to receive a thumb of the hand, a right thumb portion configured to receive the thumb of the hand, and a palm portion, the hand sleeve has a hand opening, a front periphery portion of the hand opening is adjacent to a palm side of the hand sleeve, and a rear periphery portion of the hand opening is along a rear hand side of the hand sleeve, the rear periphery portion is coupled to the bottom edge of the flap, wherein the hand opening is wide enough to permit the hand to freely insert into the hand sleeve and withdrawn from the hand sleeve;

filling ice cubes into the ice bag;

placing the ice bag into the cooler or the insulated container;

inserting the hand into the hand sleeve;

grabbing one or more of the ice cubes by the hand sleeve; and transferring the one or more of the ice cubes in a container.

* * * * *